US005634324A

United States Patent [19]

Schmachtel

[11] Patent Number: 5,634,324

[45] Date of Patent: Jun. 3, 1997

[54] BAG MAKING MACHINE

[75] Inventor: Florian Schmachtel, Linden, Germany

[73] Assignee: Hassia Verpackungsmachinen GmbH, Ranstadt, Germany

[21] Appl. No.: 578,906

[22] Filed: Dec. 27, 1995

[30] Foreign Application Priority Data

Dec. 28, 1994 [DE] Germany ..... 44 46 936.5

[51] Int. Cl.[6] ..... B65B 9/06

[52] U.S. Cl. ..... 53/546; 53/551; 53/578

[58] Field of Search ..... 53/551, 552, 553, 53/546, 550, 578, 202; 83/500, 505, 506, 425.3, 564; 493/175, 176, 295, 248, 255, 302

[56] References Cited

U.S. PATENT DOCUMENTS

| | | | |
|---|---|---|---|
| 1,791,307 | 2/1931 | Goodwin | 83/425.3 |
| 3,354,799 | 11/1967 | Harrison | 93/82 |
| 3,415,171 | 12/1968 | Wilson | 53/551 |
| 4,079,662 | 3/1978 | Puccetti et al. | 93/14 |
| 4,218,943 | 8/1980 | Osburg | 83/564 |
| 4,576,588 | 3/1986 | Umeda et al. | 493/302 |
| 4,697,403 | 10/1987 | Simpson et al. | 53/551 |
| 4,991,379 | 2/1991 | Boeckmann | 53/552 |
| 5,046,300 | 9/1991 | Custer et al. | 53/551 |
| 5,099,755 | 3/1992 | Montano et al. | 83/425.3 |

FOREIGN PATENT DOCUMENTS

| | | | |
|---|---|---|---|
| 1130714 | 4/1955 | France | 53/546 |
| 1502980 | 6/1969 | Germany | 83/564 |
| 2230462 | 1/1973 | Germany | 83/425.3 |
| 9312664 | 1/1994 | Germany | B65D 30/08 |

OTHER PUBLICATIONS

German periodical "Papierverarbeiter" Oct. 1969 pp. 24, 26.

*Primary Examiner*—Linda Johnson
*Assistant Examiner*—John Paradiso
*Attorney, Agent, or Firm*—Webb Ziesenheim Bruening Logsdon Orkin & Hanson P.C.

[57] ABSTRACT

A bag making machine for making bags from a sealable film is disclosed, wherein the heatable film is advanced along forming tubes. Most particularly, the invention is concerned with a bag making machine for the parallel manufacture, especially of tubular bag packings of a low width made from a foil cut into a plurality of strips of identical width, with the strips being continuously and cyclically formed around a corresponding number of parallel tubes.

4 Claims, 4 Drawing Sheets

BAG MAKING MACHINE

BACKGROUND OF THE INVENTION

1. Field of the Invention

This invention relates to new and useful improvements in bag making machines. More particularly, the present invention relates to bag making machines wherein a heat sealable film is advanced along forming tubes, and is transversely sealed at spaced intervals to form bags. Most particularly, however, the invention is concerned with a bag making machine for the parallel manufacture, especially of tubular bag packings of a low width made from a foil cut into a plurality of strips of identical width, with the strips being continuously and cyclically formed around a corresponding number &tubes and being longitudinally sealed. The term "parallel manufacture" conveys that a corresponding number of tubular bag packings is manufactured simultaneously and in side-by-side relationship around a number of parallel tubes.

2. Description of the Prior Art

Tubular bags of the afore-described type are shown, for example, in German Gebrauchsmuster 93 12 664. Bags of this type have relatively small dimensions, i.e. a width of as little as about 2 cm and a length of about 10 to 15 cm. Bags of this type are manufactured on bag making machines comprising foil advancing elements arranged on an apparatus frame, a strip cutting machine including tubes arranged therebehind in series and in side-by-side relationship and respectively spaced from one another by the interval of a strip width, with the circumference thereof corresponding to the strip width to which are associated—provided that no overlapping sealing is to be effected—guiding elements for narrow internal sealing strips, and elements forming the foil on both sides round the cylindrical tubes, with longitudinal sealing tools being arranged therebehind in the conveying direction and a transverse cutting means being arranged behind the tube ends, coupled to which transverse cutting means is a reciprocating transverse sealing tool. Forming of the cut strips around the tubes is performed in such a way that the abutting edges of each strip are centrally disposed above the introduced internal sealing strips and are longitudinally sealed therewith, whereafter the so formed foil hoses are transversely sealed behind the ends of the tubes, withdrawn by the desired bag length and cut from the following tubular packing foil. Bag making machines of this type, are generally satisfactory in operation. However, problems are involved with preparing the machine, in particular, the special type of bag making machine, for operation and start-up, as the foil is directly introduced into the cutting means. However, the foil is discharged behind the said cutting means in the form of strips cut in parallel. This means that each of the suspending strips, before start-up of the machine, is to be carefully placed manually in abutment with the respective tube to then mount the forming elements and start the actual operation of manufacturing the bags which, incidentally, remain one-sidedly open and unloaded to be subsequently filled and closed in a separate loading and sealing machine. The cutting means hitherto employed on bag making machines of this type are circular cutting knives seated on a spindle and arranged on a cutting table in cooperation therewith, meaning that no permanently sharp severing cuts are insured thereby. However, unsharp cutting edges on the strips are likely to result in butt joints on the bag that are partially permeable to light which would be detrimental for the processing of, for example, light-impermeable packing material.

The afore-described problem is not encountered with a bag making machine according to U.S. Pat. No. 4,079,662 as that machine only operates on one forming tube, apart from the fact that forming of the film around the forming tube is effected by means of a so-called forming shoulder. Such a forming through a forming shoulder is also employed by a packing apparatus according to U.S. Pat. No. 3,354 799, in which several tubular bag packings are simultaneously manufactured in side-by-side relationship. However, for space-saving reasons the forming tubes must be arranged in staggered relationship or at adequately large intervals in order to have available sufficient space for the forming operation through forming shoulders, i.e. four forming tubes respectively require two film bands of corresponding width respectively severed into two strips which are then fed to respectively two forming tubes not arranged in direct adjacent relationship.

SUMMARY OF THE INVENTION

The present invention is concerned with improving a bag making machine for the parallel manufacture of tubular bag packings to the effect that the traditionally difficult and relatively time-consuming operation of forming the strips around the tubes required for preparing and starting the machine, has been eliminated.

Such a machine for making bags simultaneously and in side-by-side relationship from a sealable plastic foil comprises, in the practice of the invention, a machine frame including a plurality of tubes arranged in parallel and in side-by-side relationship and being of substantially diameters; means for supplying a web of foil to said tubes which are at a space from one another that corresponds to a tube circumference less a tube diameter; means arranged ahead of the tubes for cutting the web of foil into a number of strips corresponding to the number of the tubes and being of a width corresponding to a tube circumference; means arranged on each tube for forming the strips around each of the tubes; means arranged on each tube for the longitudinal sealing of the strips to respectively one supplied narrow internal sealing strip and means for supplying the said internal sealing strips; movable means arranged behind the ends of the tubes for the withdrawal and transverse sealing and for cutting the longitudinal and transverse-sealed packings from a respectively following hose, wherein the said means for cutting the foil into strips relative to one another and in relation to the passage plane of the foil are formed in a manner to be placed apart, with the said means for forming the strips around the tubes being formed of a first part adjustable relative to the respective tube and having a semi-cylindrical forming face, and of two parts in abutment with the other half of the respective tube each having quarter-cylindrical forming faces, and with the said means for forming the strips around the tubes being coupled to set members in such a way that the abutment of the two parts having quarter-cylindrical forming faces on the respective tube is effected only after the part having the semi-cylindrical forming face with the central part of the respective strip having already been placed into abutment with the respective forming tube.

Thanks to this design of the machine according to the present invention, the foil to be cut into strips can be introduced into the machine as it can in the manufacture of standard tubular bag packings, with the said machine continuing to operate in the normal way after the start-up cycle to be particularly controlled. Although this operation involves some minor foil losses, these are, however, not comparable to the difficulties which, hitherto, had to be accepted to start up machines of this type.

With the aid of the bag making machine according to the invention, the longitudinal cuts for the strip division of the foil will be performed only after a preliminary run of the uncut web of packing foil; the initial cuts in the foil are fed therewith at least to the ends of the tubes. Thereafter, first the centers of the strips and then the strip edges are then placed in abutment with the forming tubes and sealed in the longitudinal direction. The uncut preliminary run of the foil is cut after a first transverse sealing.

Circular cutting knives for the cutting means are disclosed by the German periodical "Papierverarbeiter", dated 1969, pp. 24, 26 thereof, also teaching to place the circular cutting knives apart. However, this is not done, as it is in the present invention, in order to have the foil band first run uncut a short distance through the machine when starting up the machine.

In view of the preliminary run of the uncut foil, the strips formed during the subsequent cut are held together, no longer freely suspend downwardly and extend precisely in parallel to the tubes. The essential requirement herefore is the fact that the cutting knives and the conforming counter-elements thereof can be placed apart relative to one another and can be so maintained until the length of the preliminary run is drawn at least down to the tube ends. It is only then that the cutting means start to operate by coincidence of the cutting elements, conveying the web of the packing foil until the initial cuts are on the tube ends or slightly therebehind. As in the area of the foil forming elements foil strips are now available the forming elements can be placed in abutment with the tubes while forming the strips therearound in which position they will remain, as they did before, until the respective foil supply reel is used up.

The bag making machine of the invention is especially intended for tubular bag packings of a low width and for such types of packings that are longitudinally sealed by an inner seal strip in the area of their packing foil butt edges. However, the machine can also be employed if the tubular bags to be manufactured are to be of greater width than afore-mentioned and if sealing of the longitudinal joint is effected in a manner other than by an entrained internal seal strip, such as, for example, by overlapping strip edges.

Other objects and advantages of the invention will appear more fully hereinafter as the description proceeds, with reference being made to the accompanying drawings.

BRIEF DESCRIPTION OF THE DRAWINGS

FIGS. 5A,B are sectional views of special forms of embodiment of the strip forming elements.

DESCRIPTION OF THE PREFERRED EMBODIMENTS

Figure 1:
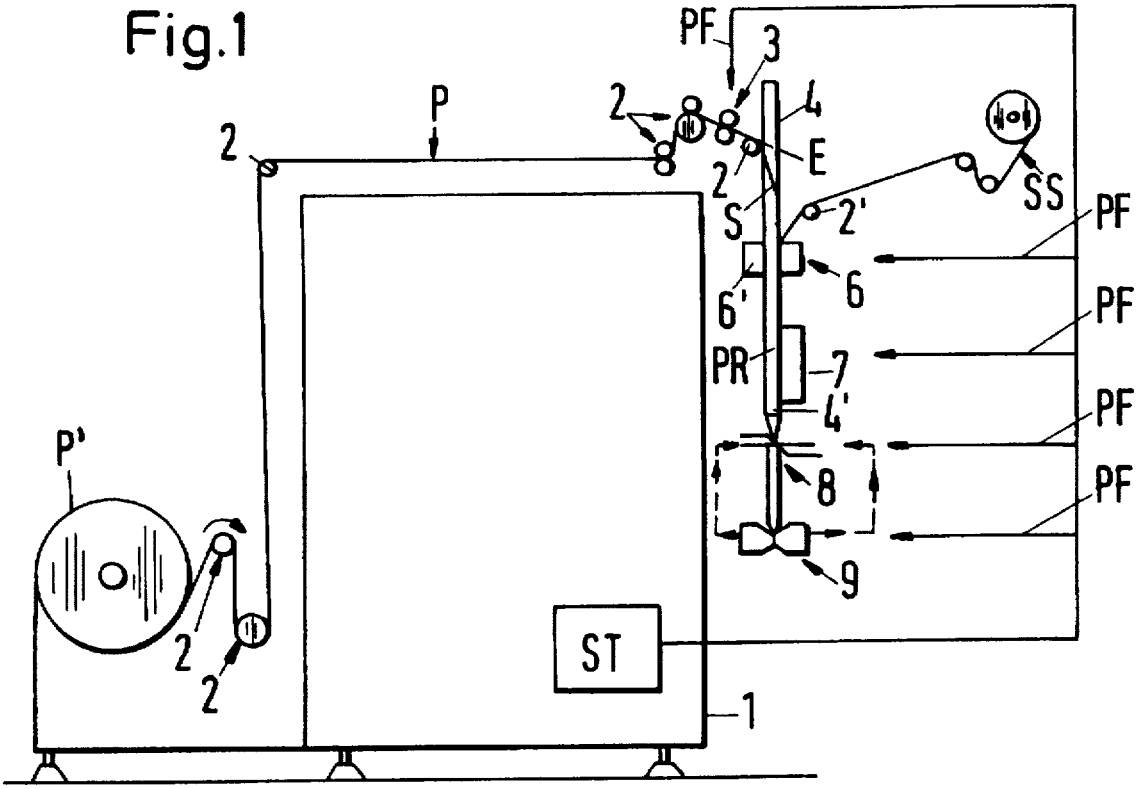
FIG. 1 is a side view of the bag making machine.
Figure 2:
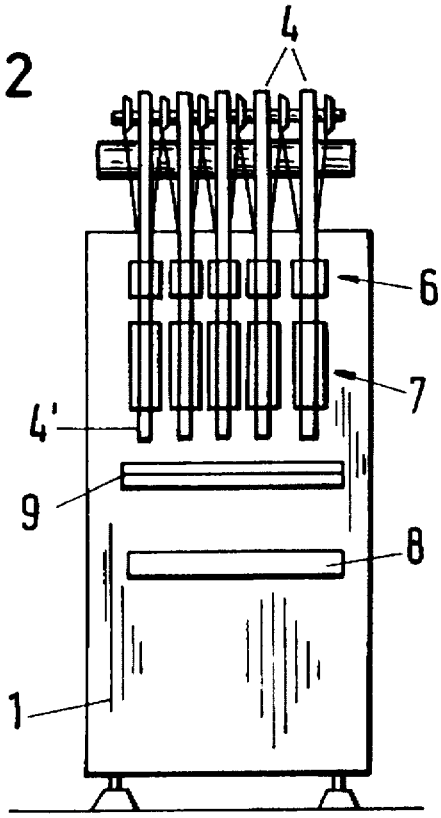
FIG. 2 is a front view of the bag making machine.
Figure 3:
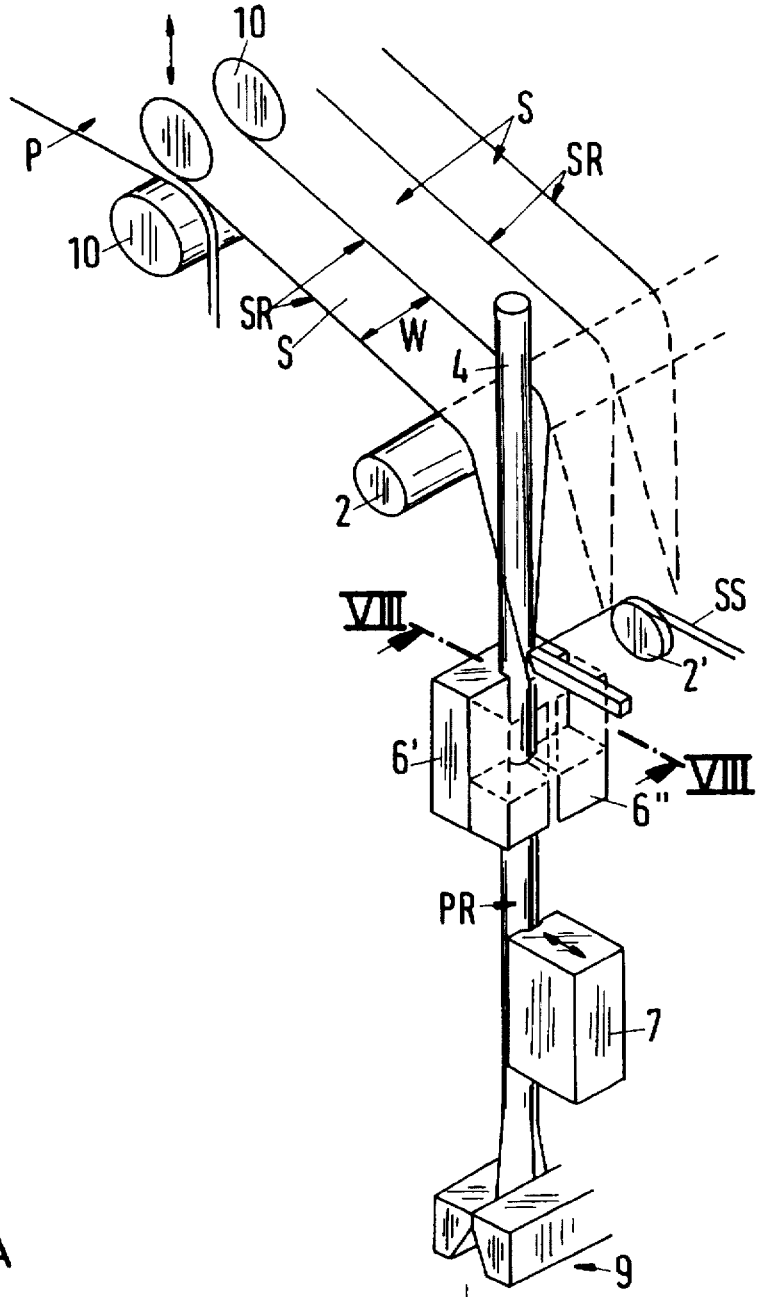
FIG. 3 is a perspective view of the manufacturing operation after the packing foil elements around the tube with reference to a strip of the foil.

Now, referring more particularly to the drawings, and especially to FIGS. 1 through 6A,B, the bag making machine comprises foil guiding elements 2 arranged on a machine frame 1, a strip cutting means 3 including tubes 4 arranged therebehind in series and in side-by-side relationship and respectively spaced at an interval of a strip width W(see FIG. 3), with the circumference corresponding to the strip width, associated to which tubes are strip forming elements 6 formed on both sides of the cylindrical tubes 4, with the longitudinal sealing tools 7, in the conveying direction, being arranged behind the strip forming elements, and a transverse cutting means 8 being arranged behind the tube ends 4', coupled to which transverse cutting means 8 is a reciprocating transverse sealing tool 9 (shown in broken lines in FIG., 1). FIG. 1 shows a means wherein for the purpose of a longitudinal sealing of the strip edges SR of the strips S, an internal sealing strip SS is guided by the other side and by a guiding element 2' to the respective tube 4. The foil P undivided down of the circular cutting knives 10, is withdrawn from the supply reel P' at the working cycle.

In the practice of the invention, it is of importance to the said bag making machine that the elements of the cutting means 3 involved in the strip cutting be designed in a manner to be placed apart relative to one another and in relation to the passage plane E of the foil P, and that among the strip forming elements 6, the elements 6' (see FIG. 3) directly and centrally seizing the strips S include a semi-cylindrical forming face F corresponding to the tube diameter, and the elements 6" seizing the strip edges SR include a corresponding quarter-cylindrical forming face F', with these two elements 6" being so coupled to set members SG (see FIG. 5B) that abutment thereof with the strip edges SR and the tube 4 is effected with the semi-cylindrical face F being already in abutting relationship.

Figure 6A:
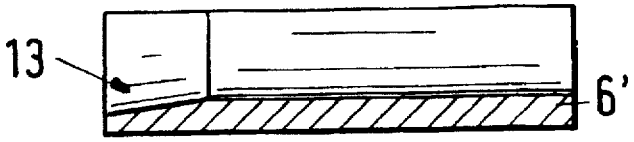
Figure 6B:
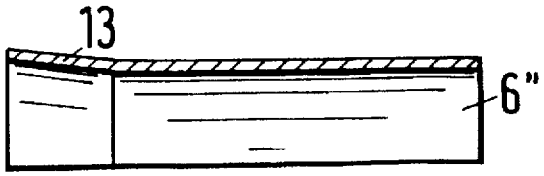

To achieve favorable conditions of inlet for the packing foil into the sealed elements 6', 6" in respect of the continuous operation of the machine following its start-up phase, it is advantageous, as shown in FIG. 6, to provide the faces F, F' on the inlet side of the packing foil respectively with a truncated extension 13.

Figure 4A:
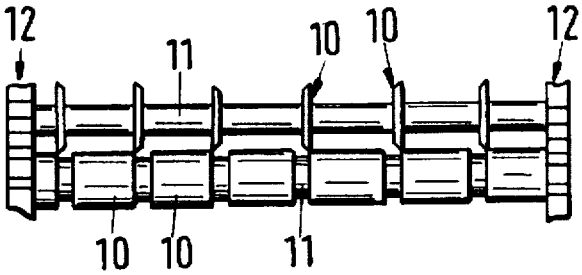
FIGS. 4A, B are front and side views of the cutting means.
Figure 4B:
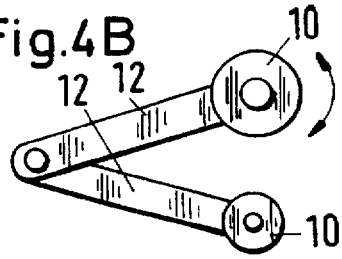

To obtain clear cut strip edges SR, in reference to FIG. 4A, the elements involved in the strip cut are formed of circular cutting knives 10 arranged in pairs with respect to one another. According to FIGS. 4A and 4B all circular cutting knives 10 are seated together on spindles 11 disposed on both sides on linkages 12 adjustable with respect to one another like scissors. The set means and drives for actuating one or the other of spindles 11 are not shown in any detail as a variety of structural alternatives are provided, it being pointed out in this respect that the scissors-type association of the linkages 12 is advantageous but not imperative.

Figure 5A:
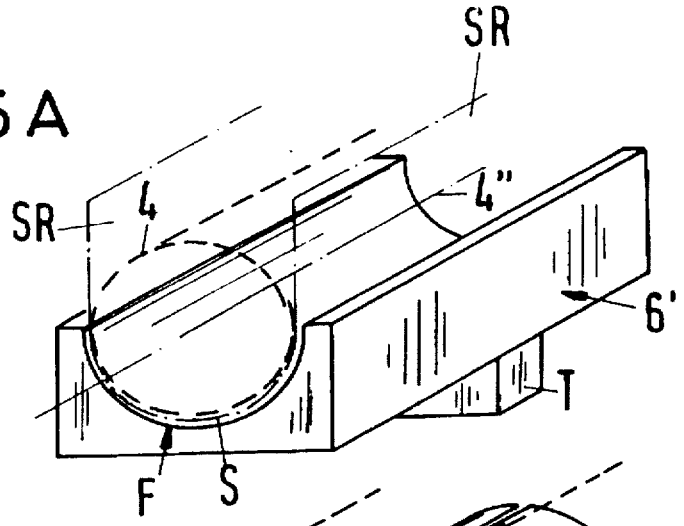
FIGS. 5A,B,C are perspective views of forms of embodiment of the strip forming elements.
Figure 5B:
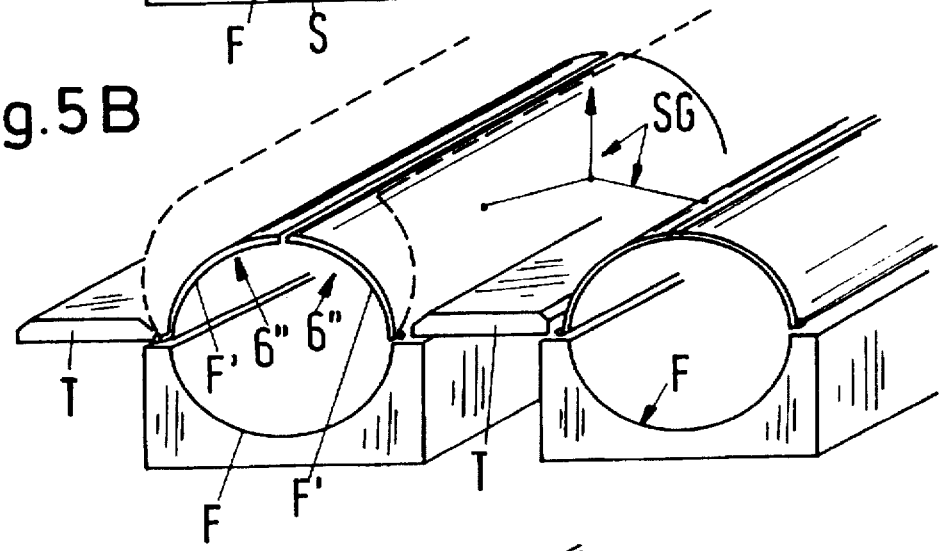

As regards the design of the strip forming elements reference is made to FIGS. 5A, B. The elements 6' directly and centrally gripping or seizing the strips which, in reference to FIG. 1, are located between machine frame 1 and tubes 4, are shaped parts of a simple configuration provided with a semi-cylindrical face of abutment F. FIG. 5A shows in broken lines how the strip S is deformed by the said element 6' on the tube 4 or placed in abutment therewith, respectively. The said elements 6' are jointly seated on a carder T which is reciprocated and adjustable toward the passage plane of the strips S in the vertical direction. The conforming counter-elements for forming around the strip edges SR are illustrated in FIG. 5B. According thereto, the quarter-cylindrical faces F' are designed on both sides as swivally arranged cups sides at the level of the tubular axis 4". The said cups are also seated on reciprocating carriers T which for all cups can be of a rake-type configuration. The said cups in an opening position (shown in broken lines) are moved toward the strip edges SR (see FIG. 5A) and are closed by means of a set linkage SG, with the strip edges SR being formed around the tubes 4. Basically, it is of importance that during moving the elements 6" to the strip edges SR, the latter can be seized by the faces F' and can be bent inwardly.

Figure 5C:
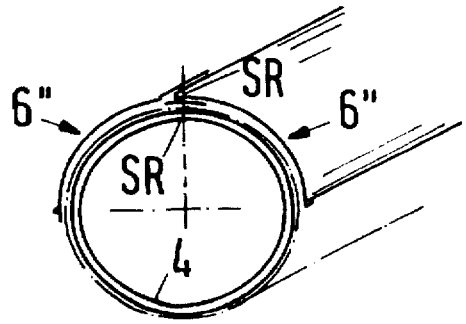

In the event that the strip edges SR are not to be sealed in abutting but rather in longitudinally overlapping relationship (which is also possible) they will, in reference to the example of embodiment according to FIG. 5B, be formed as shown in FIG. 5C, i.e. on the side of the strip edge SR to be placed thereunder, the arcuate length of one of the cups is slightly shorter and the other one for the overlapping strip edge SR is slightly longer, with sealing or the forming around of the said cup of greater length being trailing. In case of an overlapping sealing according to FIG. 5C, the strips must be cut correspondingly broader and must be fed toward the tube 4 in slightly staggered relationship.

Figure 7:
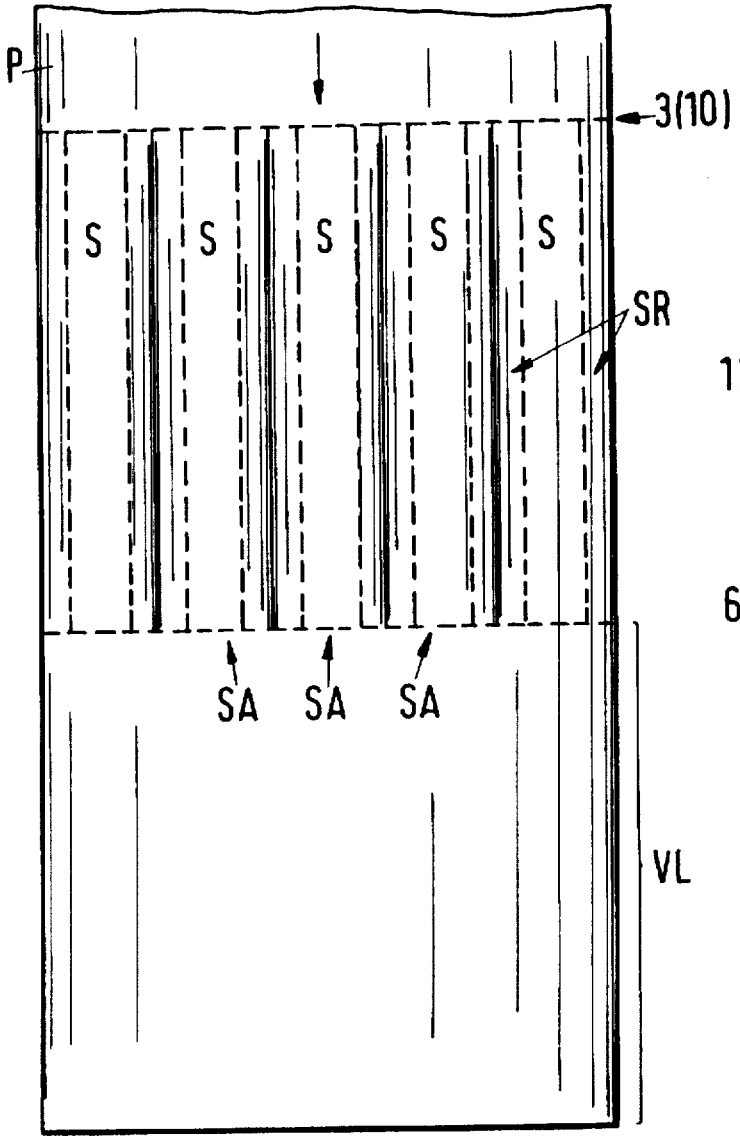
FIG. 7 is a plan view of the beginning of the foil band before the continuous operation of the machine starts up.
Figure 8:
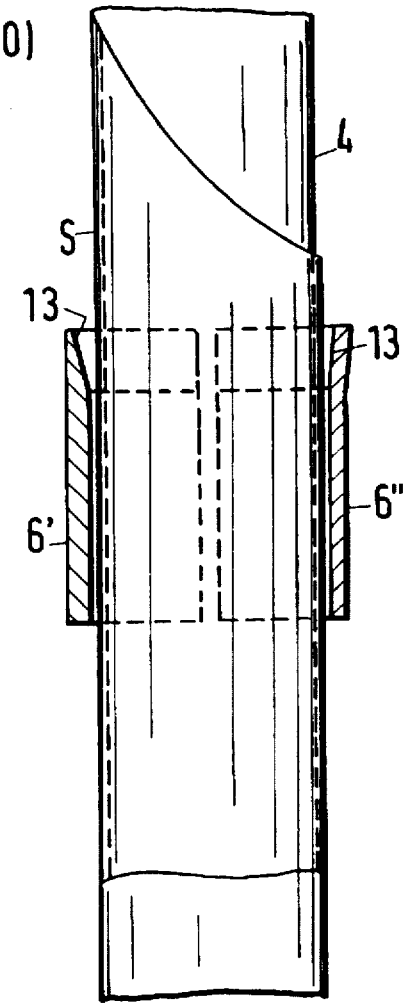
FIG. 8 is a sectional view taken along the line XIII—XIII of FIG. 3.

In reference to FIGS. 4 and 7, in preparing the machine for the continuous run, the curing knives 10 of the strip cutting means 3, the elements 6', 6" and the transverse sealing tool 9 with the sealing jaw thereof are opened so that the uncut foil, initially, can be drawn in a preliminary run VL (see FIG. 7) through the guide 2 down to slightly below the transverse sealing tool 9. The closure and start-up of the curing means 3 are coupled to the closure of the transverse sealing tool 9 and to the movement of withdrawal thereof; the foil web now cut into strips S is withdrawn until the initial cuts SA (s. FIG. 7) are located below the tube ends 4'. The elements 6, and more particularly the elements 6', are formed around the strips S and the tubes 4, deforming the strips S according to FIG. 5A, followed by the elements 6" from the other side. The transverse sealing tools 9 moved up in the meanwhile are closed, and elements 6', 6" remain closed, as do the cutting means. Hence, the machine is ready for the continuous operation until the foil supply reel P' is used up. Also, the tool 7 for longitudinal sealing is started up likewise in a programme-controlled way.

Disposed immediately below the transverse sealing tool 9, optionally in combination therewith, is a transverse cutting means 8 cutting the so formed tubular foils directly underneath the resultant transverse sealing joint, i.e. in that case transverse-sealed packing sleeves are formed on one end whereas open packing sleeves are formed on the other end for further processing, such as loading and sealing. If the loading material and the internal cross-sections of the tube 4 so permit, loading can also be through the tubes 4 in which case the packing sleeves are transversely sealed on both sides; however, the transverse cutting means must be differently located which will not require any closer explanation. Similarly, the control ST of the machine cyclically controlling the driving elements for the movable elements of the machine as described, does not require an explanation in detail. The control ST of the machine is, therefore, only schematically shown in FIG. 1, with the connection of the control to the respective set elements for the cutting means 3, the forming elements 6.6', the tools 7 for longitudinal sealing, the transverse cutter 8 and the transverse sealing jaws 9 being indicated only by flashes PF.

In summary, the operation of the bag making machine according to the invention before the continuous run is as follows:

The longitudinal cuts for the strip division of the foil web P are started only after a preliminary run VL of the uncut foil web P; the initial cuts in the foil web P are fed with the latter at least to the ends 4' of the tubes 4, whereafter first the centers of the strips S and then the strip edges SR are formed around the tubes 4 and are longitudinally sealed, while the uncut foil web P in the preliminary run VL is cut after a first transverse sealing. Thereafter, the machine operates in the routine way until the supply reel P' is used up.

Changes may be made in the construction of the machine and the arrangement of parts from those described without departing from the spirit of the invention, provided, however, that such changes fall within the scope of the claims appended hereto.

What I claim is:

1. A bag making machine for making bags simultaneously in side-by-side relationship from a sealable plastic coil, comprising:

(a) a machine frame having a plurality of substantially parallel tubes arranged in side-by-side relationship and being of substantially identical diameters, which tubes are at a space from one another that corresponds to a tube circumference less a tube diameter;

(b) cutting means for cutting a web of the foil into a number of foil strips corresponding to the number of the tubes, wherein the cutting means is arranged ahead of the tubes, with the foil strips having a width corresponding to at least a tube circumference;

(c) forming means arranged on each tube for forming one of the foil strips around each tube;

(d) sealing means arranged on each tube for longitudinally sealing the foil strips formed around the tubes to form a hose of foil;

(e) means for transversely sealing and cutting the foil hose to form longitudinally and transversely sealed packings, (f) wherein said cutting means includes a plurality of spaced apart cutting elements, (g) wherein said forming means includes: a first part adjustable relative to the tube upon which said forming means is arranged, with the first part having a semi-cylindrical forming face; and two second parts abutting the tube upon which said forming means is arranged, with the second parts having quarter-cylindrical forming faces, (h) wherein said forming means are coupled to set members such that the two second parts are formed around the respective tube after the first part, with a center part of the respective strip having already been formed around the tube, and (i) wherein the quarter-cylindrical faces of the two second parts for forming the strip edges around the respective tube are formed as cups and include hinges for swivelably disposing the cups on either side of the tubes.

2. A bag making machine according to claim 1, wherein the forming faces of the first part and the two second parts include a truncated inlet face on an inlet side.

3. A bag making machine according to claim 1, wherein the cutting means includes pairs of circular cutting knives.

4. A bag making machine according to claim 3, wherein the circular cutting knives are arranged on spindles and the spindles are located on linkages adjustable in scissors-type manner with respect to one another.

* * * * *

UNITED STATES PATENT AND TRADEMARK OFFICE

CERTIFICATE OF CORRECTION

PATENT NO. : 5,634,324

DATED : June 3, 1997

INVENTOR(S) : Florian Schmachtel

It is certified that error appears in the above-indentified patent and that said Letters Patent is hereby corrected as shown below:

Column 1 Line 16 "&tubes" should read --of tubes--.

Column 2 Line 29 after "substantially" insert --identical--.

Column 3 Line 56 "FIGS. 5A,B" should read --FIGS. 6A,B--.

Column 3 Line 57 "elements," should read --elements;--.

Column 4 Line 59 "carder" should read --carrier--.

Column 5 Line 20 "curing" should read --cutting--.

Column 5 Line 26 "curing" should read --cutting--.

Claim 1 Column 6 Line 15 "coil" should read --foil--.

Signed and Sealed this

Ninth Day of September, 1997

*Attest:*

Bruce Lehman

BRUCE LEHMAN

*Attesting Officer*

*Commissioner of Patents and Trademarks*